United States Patent [19]

Jacobs, Jr.

[11] 4,225,840

[45] Sep. 30, 1980

[54] ELECTRIC FUSE WITH SUPPORT FOR HELICALLY WOUND FUSIBLE ELEMENT

[75] Inventor: Philip C. Jacobs, Jr., Newtonville, Mass.

[73] Assignee: Gould Inc., Rolling Meadows, Ill.

[21] Appl. No.: 27,132

[22] Filed: Apr. 4, 1979

[51] Int. Cl.[3] ..... H01H 85/38

[52] U.S. Cl. ..... 337/273; 337/279

[58] Field of Search ..... 337/158, 159, 273, 276, 337/279, 280, 281

[56] References Cited

U.S. PATENT DOCUMENTS

| | | | |
|---|---|---|---|
| 3,949,342 | 4/1976 | Kozacka | 337/279 X |
| 4,167,723 | 9/1979 | Wilks | 337/273 |

*Primary Examiner*—George Harris

*Attorney, Agent, or Firm*—Erwin Salzer

[57] ABSTRACT

A non gas evolving insulating support of generally star shaped X-sect for supporting the turns of a helically wound fusible element is provided with gas evolving means affixed thereto in proximity with but spaced from the fusible element.

8 Claims, 6 Drawing Figures

ELECTRIC FUSE WITH SUPPORT FOR HELICALLY WOUND FUSIBLE ELEMENT

BACKGROUND OF THE INVENTION

In the past, supports for helically wound fusible elements have been made either of ceramic like non gassing materials or materials which decompose, evolving gases when subjected to heat.

A major disadvantage to supports of ceramic like material is that they occupy a relatively large volume within the fuse casing, which would otherwise be occupied by arc quenching filler material, without themselves contributing to the arc quenching process. On the other hand, supports made solely of gas evolving material suffer the disadvantage of producing gas both in excess of that required for arc quenching and also in excess of that which the fuse casing is able to withstand. Consequently, the high pressure associated with the gas ruptures the casing.

Currently, supports are made which are essentially a compromise of the two above mentioned approaches. That being a support of ceramic or other non gas evolving material being either partially constructed of gas evolving material or having inserts or clips of gas evolving material affixed thereto. These supports are constructed so that the fusible element contacts the gas evolving portions only in localized and predetermined regions, to thereby limit the volume of gas produced to a tolerable level. Examples of this type of support are described in U.S. Pat. Nos. 3,925,745 issued to Cameron on Dec. 9, 1975 and 4,099,153 issued to Cameron on July 4, 1978. In the above mentioned patents, the apparatus described therein depends on physical contact between the fusible element and the gas evolving material. Such an arrangement has been found to have one serious disadvantage, being that the gas evolving material is constantly subjected to heat from the fusible elements during normal, high-normal and overload operating conditions. The result being a gradual decomposition of the gas evolving material at temperatures well below the fusing temperature of the element. In such cases, the gas evolving material may become seriously decomposed or in fact, may be totally decomposed before such time as the element actually fuses and an arc is struck. Other variations of supports are disclosed in copending U.S. applications Ser. No. 883,810 filed Mar. 16, 1978, now U.S. Pat. No. 4,183,004 and Ser. No. 895,536 filed Apr. 12, 1978, now U.S. Pat. No. 4,183,004 both by Kozacka and assigned to the same assignee as the assignee of the present invention.

It would be advantageous to have a fuse in which there was a support which satisfied the requirements structurally and insulatively and which carried gas evolving means which remained essentially unaffected by fuse operating temperatures below the actual fusing temperature.

SUMMARY OF THE INVENTION

In accordance with the invention, a fusible element support is provided which carries gas evolving means in proximity to but not in contact with the fusible element. The support is generally star-shaped in X-sect and includes a plurality of radially protruding element contacting ribs arranged coaxially along the support. Gas evolving material is disposed between adjacent ribs of said support and spaced from said fusible element thereby preventing thermal decomposition at other than arcing temperatures.

DESCRIPTION OF THE PREFERRED EMBODIMENT

Figure 2:
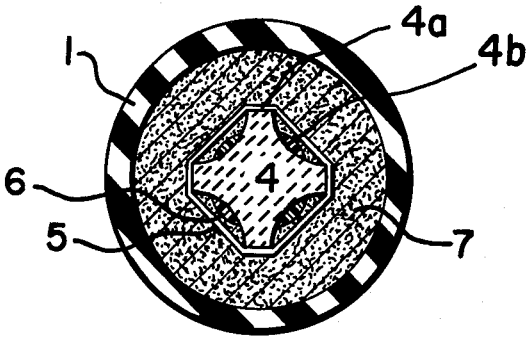
FIG. 2 is a section along A-A of FIG. 1.
Figure 1:
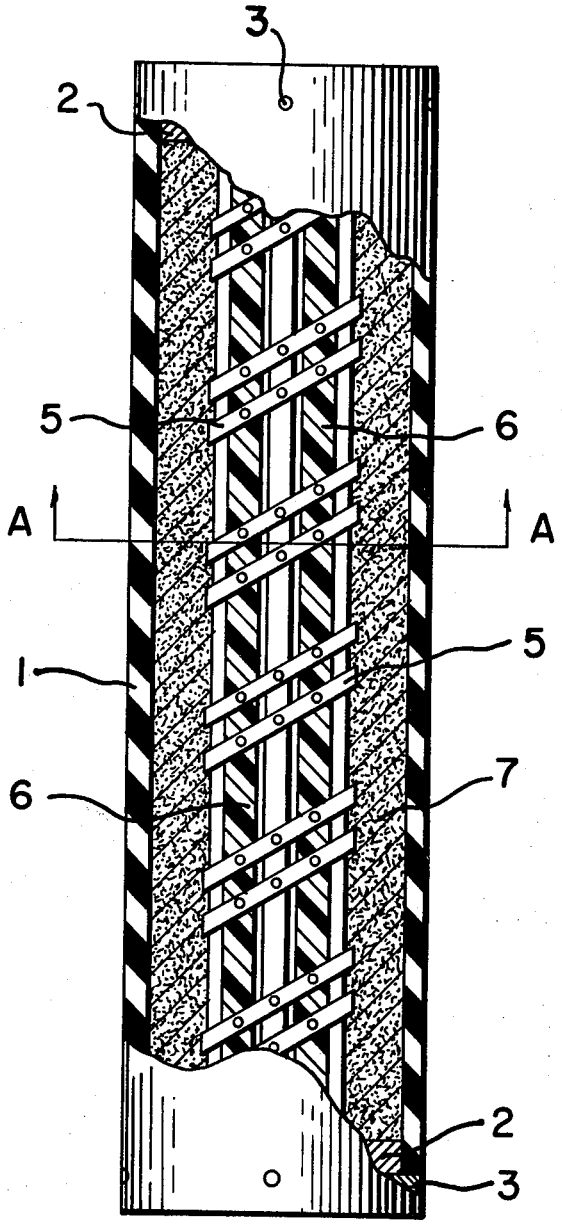
FIG. 1 is a front elevation and in part a longitudinal section of a fuse embodying the present invention.

Referring to the drawings and particularly to FIG. 1 which shows a typical fuse structure of the type intended for use with the present invention, numeral 1 refers to a cylindrical casing of electrical insulating material closed on the axial ends by terminals 2. The terminals 2 are secured to said casing by a plurality of pins 3. A non gas evolving support 4 of ceramic or other suitable material is disposed within casing 1 between terminals 2 and may engage complimentary means in said terminals, not shown, to fixedly maintain said support within said casing. Support 4 is generally star shaped in X-sect in that it has a plurality of longitudinally extending radially protruding ribs 4*a*. The ribs 4*a* support the helical windings of at least one fusible element 5 which extend between terminals 2 and conductively inter-connect the same. Support 4 includes regions 4*b* between adjacent ribs 4*a* to which gas evolving material 6 is affixed in spaced relation to fusible element 5. A pulverulent arc quenching filler 7 is disposed within casing 1 and embeds support 4, fusible element 5, and gas producing material 6 therein. In the embodiment of FIGS. 1 & 2, the gas evolving material 6 extending axially the length of support 4 and is disposed between each of the plurality of ribs 4*a*. This embodiment is suitable for use in fuses which may or may not incorporate an element severing overlay of a low melting point metal with the fusible element. The gas evolving material being substantially circumferentially disposed and extending axially the length of the fuse, provides available gas regardless of the point of fusion and arc initiation.

FIG. 2 is a section along A—A of FIG. 1 and illustrates the star shaped configuration of support 4. Fusible element 5 is wound helically around support 4 contacting said support only at ribs 4*a*. This helical arrangement enables a greater length of said element to be accommodated in a casing of practical length, and exposes a maximum length of fusible element 5 to arc quenching filler 7. Gas evolving material 6, affixed to support 4 in region 4*b*, is spaced from fusible element 5 so that under other than fusing temperatures, gas producing material 6 remains essentially uneffected. When the fusion temperature is reached, the arc plasma and temperature associated therewith is sufficient to decompose material 6 which liberates and expells non ionized, cooling gases into the arc zone.

Figure 3:
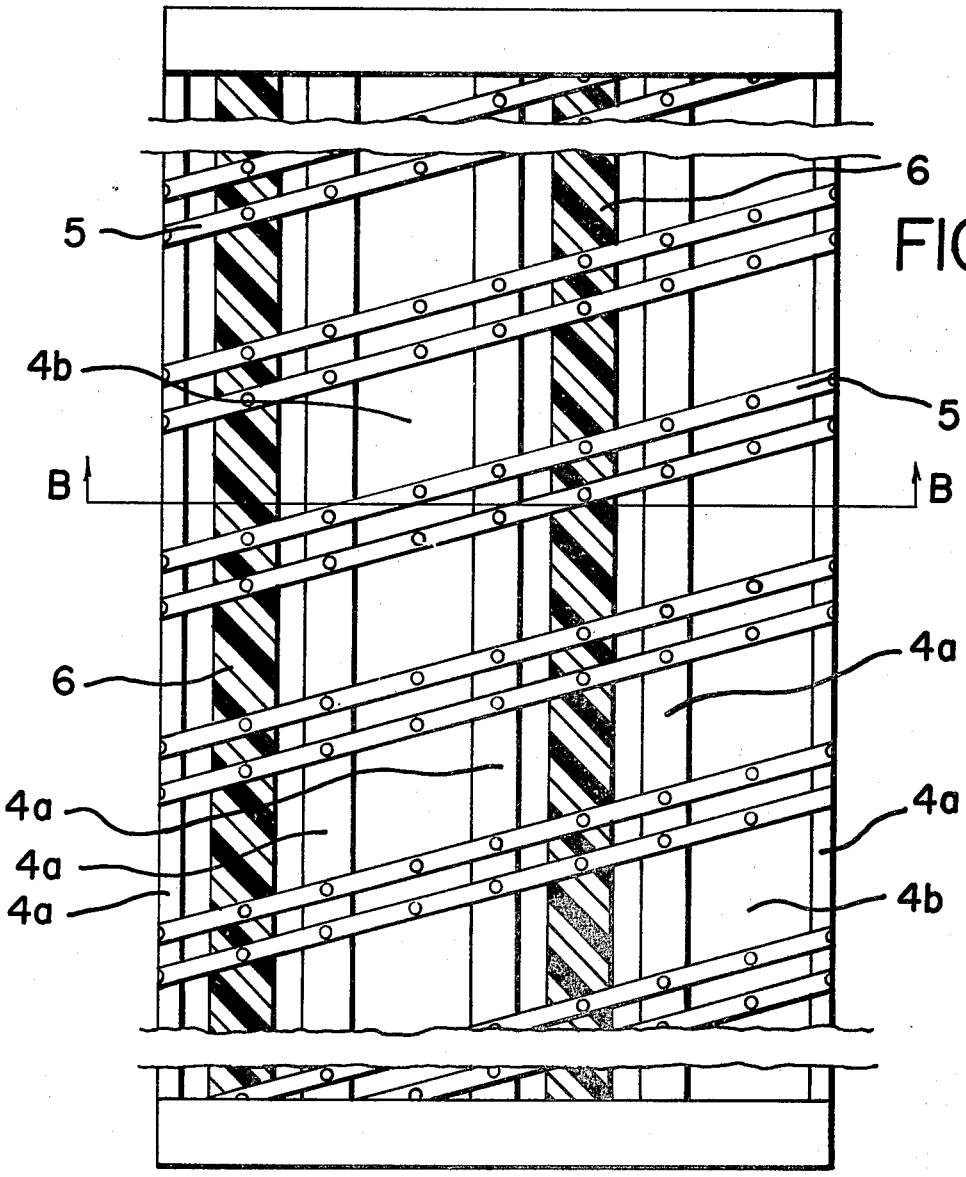
FIG. 3 is a longitudinal planar diagram of a support embodying a variation of the present invention obtained by cutting the support along one of the ribs and spreading the support into the plane of the paper.

Referring now to FIG. 3, a second embodiment of the present invention is shown in which the gas producing material 6 is affixed to said support between alternating ribs 4a and extending axially the length of support 4, thereby leaving alternating regions 4B empty. Gas producing material 6 is affixed to support 4 by means of an epoxy or other suitable adhesive. It may also be provided in a paste or putty-like consistency which is brushed onto said support or affixed by contact pressure. The manner in which it is affixed is of secondary importance to its spaced relation from said fusible elements thereafter.

Figure 4:
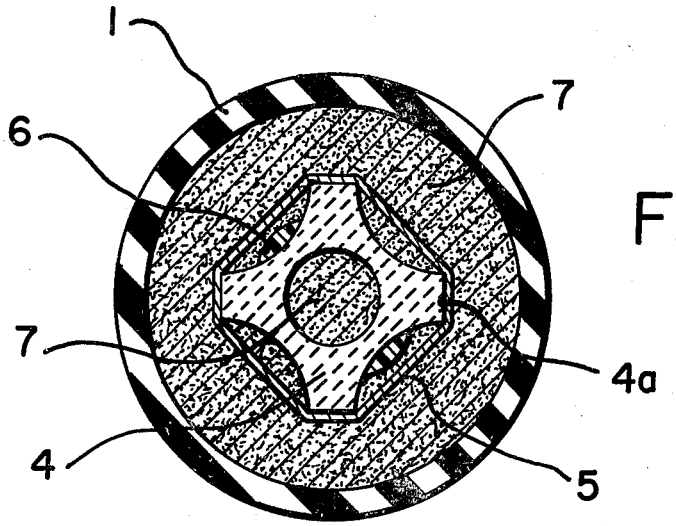
FIG. 4 is a section along B—B of FIG. 3.

FIG. 4 is a section along B—B of FIG. 3 again showing the spaced relation between fusible element 5 and gas producing material 6. In this case support 4 is hollow to accommodate additional pulverulent arc quenching filler 7 within casing 1. Gas producing material 6 is positioned between every other rib 4a.

Figure 6:
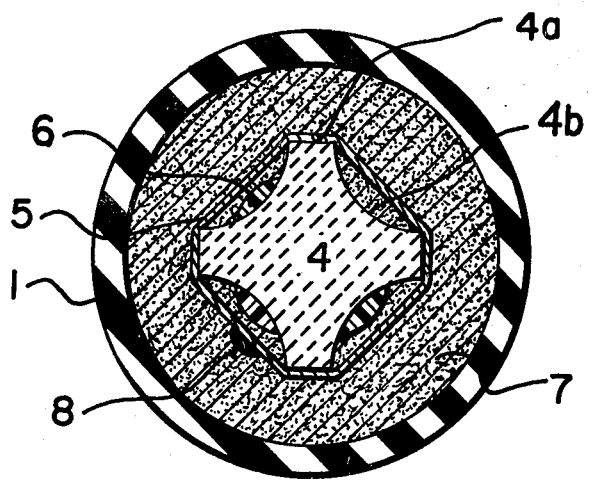
FIG. 6 is a section along C—C of FIG. 5.
Figure 5:
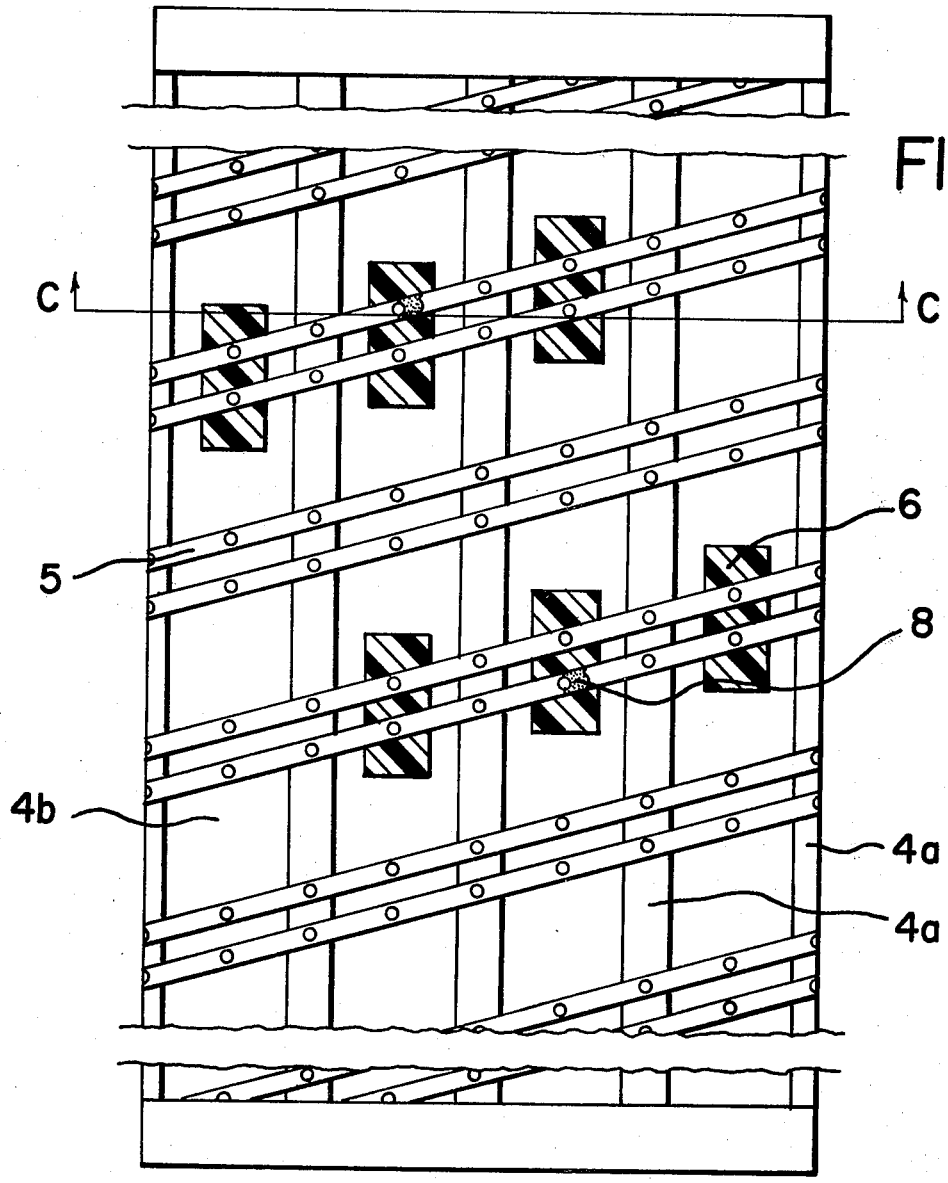
FIG. 5 is a longitudinal planar diagram of a support with yet another variation of the present invention obtained by cutting the support along one of the ribs and spreading the support into the plane of the paper.

Referring now to FIG. 5, a third embodiment of the present invention is shown wherein the gas evolving material 6 is affixed to support 4 in predetermined localized regions. These regions are determined by the positioning of a low melting point metal overlay 8 on the fusible element. Such overlays are used in the fuse art to produce a fusible element with a thermal weak spot which allows one to determine the point of interruption along said fusible element, In the embodiment of FIGS. 5 & 6, gas producing material is placed under said overlays and/or additionally between the ribs radially adjacent to said overlay. Such an arrangement provides cooling gas blasts to the arc zone on fusion and in the event of excessive element burnback, gas is produced to effectively quench the residual arc as it burns across ribs 4a and passes over gas producing material 6.

I claim as my invention:

1. An electric fuse comprising:

(a) a casing of electric insulating material;

(b) a pair of terminals closing the ends of said casing;

(c) a pulverulent arc-quenching filler disposed within said casing;

(d) a helically wound fusible element conductively interconnecting said pair of terminals;

(e) a non gas evolving support for said fusible element extending in a direction longitudinally of said casing, said support being immersed in said arc-quenching filler and comprising a core and a plurality of ribs protruding from said core; and (f) gas evolving means affixed to said support between adjacent ribs of said core and spaced from said fusible element so as to be essentially unaffected by temperatures lower than arc-temperatures, said gas-evolving means evolving an arc extinguishing gas upon conversion of said fusible element into an arc incident to blowing of said fuse.

2. An electric fuse as specified in claim 1 in which said fusible element means includes at least one overlay of a metal having a lower melting point than that of the fusible element.

3. An electric fuse as specified in claim 2 in which said gas evolving means are affixed to said support in regions proximal to said overlay of lower melting point metal.

4. An electric fuse as specified in claim 1 in which said gas evolving means, affixed to said support, occupies a portion of the space between said ribs.

5. An electric fuse as specified in claim 1 in which said gas evolving means affixed to said support occupies a portion of the space between every adjacent rib and extends axially the length of said ribs.

6. An electric fuse as specified in claim 1 in which said gas evolving means affixed to said support occupies a portion of the space between every other rib and extends axially the length of said ribs.

7. An electric fuse as specified in claim 1 in which said gas evolving means is affixed to said support by an adhesive.

8. An electric fuse as specified in claim 1 in which said gas evolving means is in the form of a putty and is affixed to said support by contact pressure.

* * * * *